US010190069B2

(12) United States Patent
Zhang et al.

(10) Patent No.: US 10,190,069 B2
(45) Date of Patent: Jan. 29, 2019

(54) LUBRICATING COMPOSITION CONTAINING A THIOCARBAMATE COMPOUND

(75) Inventors: Yanshi Zhang, Shaker Hts., OH (US); Seth L. Crawley, Mentor, OH (US); Richard Yodice, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 108 days.

(21) Appl. No.: 14/003,929

(22) PCT Filed: Mar. 7, 2012

(86) PCT No.: PCT/US2012/027951

§ 371 (c)(1),
(2), (4) Date: Oct. 17, 2013

(87) PCT Pub. No.: WO2012/122202

PCT Pub. Date: Sep. 13, 2012

(65) Prior Publication Data

US 2014/0045737 A1 Feb. 13, 2014

Related U.S. Application Data

(60) Provisional application No. 61/451,152, filed on Mar. 10, 2011.

(51) Int. Cl.

| | |
|---|---|
| ***C10M 169/04*** | (2006.01) |
| ***C10M 135/22*** | (2006.01) |
| ***C10M 135/18*** | (2006.01) |

(52) U.S. Cl.

CPC ..... *C10M 135/22* (2013.01); *C10M 135/18* (2013.01); *C10M 2207/026* (2013.01); *C10M 2207/042* (2013.01); *C10M 2207/262* (2013.01); *C10M 2207/282* (2013.01); *C10M 2207/283* (2013.01); *C10M 2215/04* (2013.01); *C10M 2215/082* (2013.01); *C10M 2215/221* (2013.01); *C10M 2215/28* (2013.01); *C10M 2219/046* (2013.01); *C10M 2219/066* (2013.01); *C10M 2219/089* (2013.01); *C10M 2223/043* (2013.01); *C10M 2223/045* (2013.01); *C10N 2230/42* (2013.01); *C10N 2230/43* (2013.01); *C10N 2230/45* (2013.01); *C10N 2240/102* (2013.01)

(58) Field of Classification Search

CPC ..... C10M 135/18

USPC ..... 508/287

See application file for complete search history.

(56) References Cited

U.S. PATENT DOCUMENTS

| | | | | |
|---|---|---|---|---|
| 2,897,152 | A | 7/1959 | Scotchford et al. | |
| 3,896,050 | A | 7/1975 | White | |
| 3,966,623 | A | 6/1976 | Krug et al. | |
| 4,012,408 | A | 3/1977 | White | |
| 4,225,450 | A | 9/1980 | Rosenberger | |
| 4,491,527 | A | 1/1985 | Lange et al. | |
| 4,734,209 | A | 3/1988 | Phillips et al. | |
| 4,957,643 | A | 9/1990 | Lam | |
| 5,686,397 | A | 11/1997 | Baranski et al. | |
| 5,693,598 | A | 12/1997 | Abraham et al. | |
| 2003/0096716 | A1* | 5/2003 | Locke et al. | 508/525 |
| 2003/0139301 | A1 | 7/2003 | Gatto | |
| 2004/0038835 | A1 | 2/2004 | Chasan et al. | |
| 2006/0264341 | A1* | 11/2006 | Culley | C10M 133/44 508/271 |

FOREIGN PATENT DOCUMENTS

| | | |
|---|---|---|
| EP | 1642954 | 4/2006 |
| HU | 202198 | 2/1991 |
| WO | 2004015043 | 2/2004 |

OTHER PUBLICATIONS

Barahman, "Synthesis of Thiocarbamates from Thiols and Isocyanates Under Catalyst and Solvent-Free Conditions", Chemical Monthly, an International Journal of Chemistry, Springer-Verlag, AU, vol. 139, No. 2., Jan. 11, 2008.

Written Opinion from corresponding International Appln. No. PCT/US2012/027951 dated Jun. 14, 2012.

Search Report from corresponding International Appln. No. PCT/US2012/027951 dated Jun. 14, 2012.

Corresponding International Publication No. WO 2012/122202 A1 published Sep. 13, 2012.

* cited by examiner

*Primary Examiner* — Prem C Singh
*Assistant Examiner* — Francis C Campanell
(74) *Attorney, Agent, or Firm* — Michael Miller; Chris Hilker

(57) ABSTRACT

The invention provides a lubricating composition containing an oil of lubricating viscosity and an ashless thiocarbamate compound having an optionally-substituted hydrocarbyl group on an S-atom and an optionally-substituted hydrocarbyl group on an N-atom. The invention further relates to a method of the lubricating an internal combustion engine with the lubricating composition.

17 Claims, No Drawings

LUBRICATING COMPOSITION CONTAINING A THIOCARBAMATE COMPOUND

FIELD OF INVENTION

The invention provides a lubricating composition containing an oil of lubricating viscosity and an ashless thiocarbamate compound having an optionally-substituted hydrocarbyl group on an S-atom and an optionally-substituted hydrocarbyl group on an N-atom. The invention further relates to the use of the lubricating composition in an internal combustion engine.

BACKGROUND OF THE INVENTION

It is well known for lubricating oils to contain a number of surface active additives (including antiwear agents, dispersants, or detergents) used to protect internal combustion engines from wear, soot deposits and acid build up. Often, such surface active additives including zinc dialkyldithiophosphates (common antiwear additive for engine lubricating oils is zinc dialkyldithiophosphate (ZDDP)) or dispersants can have harmful effects on bearing corrosion, dispersancy or friction performance.

Many of these additive chemistries are corrosive to lead or copper. It is difficult for formulators to meet the present engine oil specifications by employing certain beneficial additives while also meeting the specification for lead or copper corrosion. With introduction of industry specifications and legislation to reduce emissions there are tighter limits on ash-containing, sulphur-containing and phosphorus-containing limits have been introduced. For example, industry specifications such as API CJ-4, as well as MACK T-11 and Mack T-12 tests, have been introduced for heavy duty diesel engines.

There has been a commercial trend for reduction in emissions (typically reduction of NOx formation, SOx formation) and a reduction in sulphated ash in engine oil lubricants. Consequently, the amounts of phosphorus-containing antiwear agents such as ZDDP, overbased detergents such as calcium or magnesium sulphonates and phenates have been reduced. As a consequence, ashless additives have been contemplated to provide friction or antiwear performance. It is known that surface active ashless compounds such as ashless dispersants may in some instances increase corrosion of metal, namely, copper or lead. Copper and lead corrosion may be from bearings and other metal engine components derived from alloys using copper or lead. Consequently, there is a need to reduce the amount of corrosion caused by ashless additives.

Various attempts have been made to reduce corrosion caused by ashless additives. These attempts include those disclosed in US Patent Application US 2004/038835; U.S. Pat. Nos. 3,966,623, 3,896,050, 4,012,408, 4,734,209, 4,491,527; and European publication EP 1 642 954.

European Patent Publication 1 532 232 A1 discloses certain 1,2,4-triazole compounds allows the co-use of corrosive additives such as sulfur-containing additives and vegetable oil-derived friction modifiers while at the same time meeting ASTM D 4485 specifications.

International Publication WO 2010/096291 A1 discloses a product obtainable from a 1,4-conjugate addition of an aminocarboxylic acid to an activated olefin. The product is useful in an internal combustion engine lubricant to reduce lead corrosion.

SUMMARY OF THE INVENTION

The inventors of this invention have discovered a lubricating composition that is capable of providing at least one of antiwear performance, friction modification (particularly for enhancing fuel economy), extreme pressure performance, antioxidant performance, lead or copper (typically lead) corrosion inhibition, or seal swell performance. In one embodiment the inventors of this invention have discovered a lubricating composition that is capable of providing at least one of lead or copper (typically lead) corrosion inhibition.

As used herein reference to the amounts of additives present in the lubricating composition disclosed herein are quoted on an oil free basis, i.e., amount of actives.

In one embodiment the present invention provides a lubricating composition comprising an oil of lubricating viscosity and an ashless thiocarbamate compound having an optionally-substituted hydrocarbyl group on an S-atom and an optionally-substituted hydrocarbyl group on an N-atom.

In one embodiment the present invention provides a lubricating composition comprising an oil of lubricating viscosity and an ashless thiocarbamate compound having an optionally-substituted hydrocarbyl group on an S-atom and an optionally-substituted hydrocarbyl group on an N-atom, wherein the S-hydrocarbyl atom may be free of a nitrogen-containing heterocycle.

In one embodiment the present invention provides a lubricating composition comprising an oil of lubricating viscosity and an ashless thiocarbamate compound having an optionally-substituted hydrocarbyl group on an S-atom and an optionally-substituted hydrocarbyl group on an N-atom, wherein the N-hydrocarbyl group may be free of a cyclic carbonyl group.

In one embodiment the present invention provides a lubricating composition comprising an oil of lubricating viscosity and an ashless thiocarbamate compound having an optionally-substituted hydrocarbyl group on an S-atom and an optionally-substituted hydrocarbyl group on an N-atom, wherein the N-hydrocarbyl group may be free of a cyclic carbonyl group, and wherein the S-hydrocarbyl group may be free of a nitrogen-containing heterocycle.

In one embodiment the present invention provides a method of lubricating an internal combustion engine comprising supplying to the internal combustion engine a lubricating composition as disclosed herein.

In one embodiment the present invention provides a method of lubricating an internal combustion engine comprising supplying to the internal combustion engine a lubricating composition as disclosed herein, wherein the engine has a steel surface on a cylinder bore, a cylinder block, or a piston ring.

In one embodiment the present invention provides a method of lubricating a heavy duty diesel internal combustion engine comprising supplying to the heavy duty diesel internal combustion engine a lubricating composition as disclosed herein.

In one embodiment the present invention provides for the use of the ashless thiocarbamate compound having an optionally-substituted hydrocarbyl group on an S-atom and an optionally-substituted hydrocarbyl group on an N-atom disclosed herein as a copper corrosion additive and/or lead corrosion additive in an internal combustion engine.

In one embodiment the present invention provides for the use of the ashless thiocarbamate compound having an optionally-substituted hydrocarbyl group on an S-atom and an optionally-substituted hydrocarbyl group on an N-atom disclosed herein as a copper corrosion additive and/or lead corrosion additive in a heavy duty diesel internal combustion engine.

In one embodiment the invention provides a lubricating composition wherein the ashless thiocarbamate compound having an optionally-substituted hydrocarbyl group on an S-atom and an optionally-substituted hydrocarbyl group on an N-atom may be present at 0.01 wt % to 5 wt %, or 0.05 wt % to 2.5 wt %, or 0.1 wt % to 2 wt %, or 0.25 wt % to 1.5 wt %, or 0.5 wt % to 1 wt % of the lubricating composition.

In one embodiment the invention provides a lubricating composition wherein the ashless thiocarbamate compound having an optionally-substituted hydrocarbyl group on an S-atom and an optionally-substituted hydrocarbyl group on an N-atom may be present at 0.25 wt % to 1 wt % of the lubricating composition.

The lubricating composition may have a TBN (Total Base Number) in the range of 3 to 15, or 4 to 12, or 6 to 10 mg KOH/g.

DETAILED DESCRIPTION OF THE INVENTION

The present invention provides a lubricating composition, a method for lubricating an engine as disclosed above, and a use of the ashless thiocarbamate compounds as disclosed above.

Ashless Thiocarbamate

The ashless thiocarbamate compound having an optionally-substituted hydrocarbyl group on an S-atom and an optionally-substituted hydrocarbyl group on an N-atom may be represented by the formula (1)

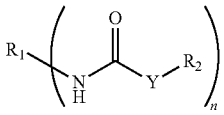

wherein n may be 1 or 2;

Y may be oxygen or sulphur, provided that when n=1, Y is sulphur, and when n=2, at least one Y is sulphur;

$R_1$ may be an optionally-substituted hydrocarbyl group. $R_1$ may contain 2 to 60, or 4 to 30, or 6 to 20 carbon atoms, or a heterocycle (or substituted equivalents thereof), with the proviso that $R_1$ may be free of a nitrogen-containing heterocycle; and $R_2$ may be an optionally-substituted hydrocarbyl group or an optionally-substituted hydrocarbylene group [i.e., 2 points of attachment]. $R_2$ may contain 2 to 60, or 4 to 30, or 6 to 20 carbon atoms, or a heterocycle (or substituted equivalents thereof).

As used herein the expression "optionally-substituted hydrocarbyl" is intended to include hydrocarbyl groups that have substituents that are more polar than a hydrocarbon group. Examples of polar groups include esters, heterocycles, amides, imides, phosphates, sulphonates, sulphates, nitrates, nitriles, or ethers. The optionally-substituted hydrocarbylene group is defined substantially the same as optionally-substituted hydrocarbyl, except the hydrocarbylene group has 2 points of attachment.

The ashless thiocarbamate compound having an optionally-substituted hydrocarbyl group on an S-atom and an optionally-substituted hydrocarbyl group on an N-atom may be represented by the formula (2):

formula (2)

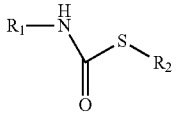

wherein $R_1$ may be an optionally-substituted hydrocarbyl group containing 2 to 60, or 4 to 30, or 6 to 20 carbon atoms, or a heterocycle (or substituted equivalents thereof); and $R_2$ may be a hydrocarbyl group containing 2 to 60, or 4 to 30, or 6 to 20 carbon atoms, or a heterocycle (or substituted equivalents thereof) with the proviso that $R_2$ (i.e., the S-hydrocarbyl atom) may be free of a nitrogen-containing heterocycle.

The ashless thiocarbamate compound having an optionally-substituted hydrocarbyl group on an S-atom and an optionally-substituted hydrocarbyl group on an N-atom may be represented by the formula (3):

formula (3)

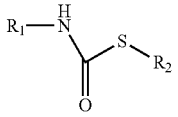

wherein $R_1$ may be an optionally-substituted hydrocarbyl group (typically a hydrocarbyl group containing 2 to 60, or 4 to 30, or 6 to 20 carbon atoms, or a heterocycle (or substituted equivalents thereof), with the proviso that $R_1$ may be free of a nitrogen-containing heterocycle); and $R_2$ may be an optionally substituted hydrocarbyl group (typically a hydrocarbyl group containing 2 to 60, or 4 to 30, or 6 to 20 carbon atoms, or a heterocycle (or substituted equivalents thereof) with the proviso that $R_2$ (i.e., the S-hydrocarbyl atom) may be free of a nitrogen-containing heterocycle.

The ashless thiocarbamate compound having an optionally-substituted hydrocarbyl group on an S-atom and an optionally-substituted hydrocarbyl group on an N-atom may be represented by the formula (4):

formula (4)

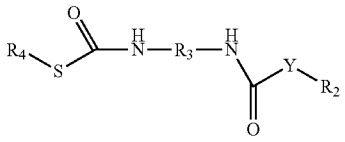

wherein

Y may be >O, or >S, or >NH or >$NR_5$ (typically Y may be >O, or >S);

$R_2$ may be a hydrocarbyl group containing 2 to 60, or 4 to 30, or 6 to 20 carbon atoms, or a heterocycle (or substituted equivalents thereof) with the proviso that $R_2$ (i.e., the S-hydrocarbyl atom) may be free of a nitrogen-containing heterocycle;

$R_3$ may be a hydrocarbylene group (typically containing 1 to 16, or 2 to 10, or 4 to 8, such as 6 carbon atoms), or a heterocycle (or substituted equivalents thereof);

$R_4$ may be a hydrocarbyl group containing 2 to 60, or 4 to 30, or 6 to 20 carbon atoms, or a heterocycle (or substituted equivalents thereof); and $R_5$ may be a hydrocarbyl group containing 1 to 30, or 1 to 20, or 1 to 10, or 1 to 5 carbon atoms.

$R_3$ may be a linear, branched or cyclic group. If $R_3$ is cyclic, it may be aromatic or non-aromatic.

The ashless thiocarbamate compound having an optionally-substituted hydrocarbyl group on an S-atom and an optionally-substituted hydrocarbyl group on an N-atom may contain one or more linear hydrocarbyl groups.

The ashless thiocarbamate compound having an optionally-substituted hydrocarbyl group on an S-atom and an optionally-substituted hydrocarbyl group on an N-atom may contain one linear hydrocarbyl group and one branched hydrocarbyl group. The branched hydrocarbyl group may be an α-branched hydrocarbyl group, or a β-hydrocarbyl group. The branched hydrocarbyl group may, for instance, be a 2-ethylhexyl group.

The ashless thiocarbamate compound having an optionally-substituted hydrocarbyl group on an S-atom and an optionally-substituted hydrocarbyl group on an N-atom may contain one or more cyclic hydrocarbyl groups.

A cyclic hydrocarbyl group may be aromatic or non-aromatic. The cyclic hydrocarbyl group may be a heterocycle or a non-heterocycle.

A non-aromatic hydrocarbyl group may include a cycloalkane, or a pyrrolidinone. Typically, the non-aromatic hydrocarbyl group may be cyclohexane or pyrrolidinone.

As used herein reference to "a" specific compound such as "a pyrrole", or "a pyrrolidine" and so on is intended to include both the chemical itself (i.e., pyrrole, pyrrolidine), and their substituted equivalents thereof.

A non-heterocycle may include a phenyl group, or a naphthalyl group.

A heterocycle may for instance include a pyrrole, a pyrrolidine, a pyrrolidinone, a pyridine, a piperidine, a pyrone, a pyrazole, a pyrazine, pyridazine, a 1,2-diazole, a 1,3-diazole, a 1,2,4-triazole, a benzotriazole, a quinoline, an indole, an imidazole, an oxazole, an oxazoline, a thiazole, a thiophene, an indolizine, a pyrimidine, a triazine, a furan, a tetrahydrofuran, a dihydrofuran, or mixtures thereof.

In one embodiment the heterocycle may be a tetrazole, or a triazole (either a 1,2,4-triazole, or a benzotriazole), or a pyridine.

The ashless thiocarbamate compound having an optionally-substituted hydrocarbyl group on an S-atom and an optionally-substituted hydrocarbyl group on an N-atom may contain one cyclic hydrocarbyl group and one linear hydrocarbyl group.

The ashless thiocarbamate compound having an optionally-substituted hydrocarbyl group on an S-atom and an optionally-substituted-hydrocarbyl group on an N-atom may contain one heterocyclic hydrocarbyl group and one linear hydrocarbyl group.

The ashless thiocarbamate compound having an optionally-substituted hydrocarbyl group on an S-atom and an optionally-substituted hydrocarbyl group on an N-atom may be halogen free.

As described herein, ashless thiocarbamate compound having an optionally-substituted hydrocarbyl group on an S-atom and an optionally-substituted hydrocarbyl group on an N-atom may have the N-hydrocarbyl group free of a cyclic carbonyl group or, alternatively, containing a cyclic carbonyl group (generally free of a cyclic carbonyl group). The cyclic carbonyl group may be a saturated or unsaturated system of general formulae (5) or (6):

formula (5)

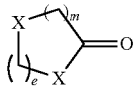

or formula (6)

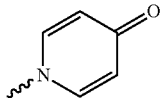

wherein m may be 0, 1 or 2;

X may be a $>NR_6$;

e may be 1 or 2;

the wavy bond is a direct bond to the carbonyl group of the ashless thiocarbamate compound having an optionally-substituted hydrocarbyl group on an S-atom and an optionally-substituted hydrocarbyl group on an N-atom; and $R_6$ may be H, an hydrocarbyl group typically containing 1 to 5, or 1 to 2 carbon atoms, or a direct bond to the carbonyl group of the ashless thiocarbamate compound having an optionally-substituted hydrocarbyl group on an S-atom and an optionally-substituted hydrocarbyl group on an N-atom, with the proviso that at least one of the $R_6$ groups is a direct bond to the carbonyl group of the ashless thiocarbamate compound having an optionally-substituted hydrocarbyl group on an S-atom and an optionally-substituted hydrocarbyl group on an N-atom. Typically when m equals 0, e may be 2; and when m equals 1 or 2, e may be 1.

The ashless thiocarbamate compound having an optionally-substituted hydrocarbyl group on an S-atom and an optionally-substituted hydrocarbyl group on an N-atom may be prepared by a process comprising reacting (i) a hydrocarbyl-substituted isocyanate or a hydrocarbyl-substituted diisocyanate, and (ii) a hydrocarbyl-substituted thiol, optionally in presence of a heterocycle.

The mole ratio of hydrocarbyl-substituted thiol to either the hydrocarbyl-substituted isocyanate or the hydrocarbyl-substituted diisocyanate may vary from 0.5:1 to 3:1, typically 1:1 or 1:2. For a monoisocyanate, the mole ratio may be 0.5:1 to 1.5:1. For a diisocyanate, the mole ratio may be 1:1 to 3:1.

The product of reacting a hydrocarbyl-substituted isocyanate and a hydrocarbyl-substituted thiol may have a structure defined by formulae (2) or (3) above.

The product of reacting a hydrocarbyl-substituted diisocyanate and a hydrocarbyl-substituted thiol may have a structure defined by formula (4) above.

The reaction to prepare the ashless thiocarbamate compound having an optionally-substituted hydrocarbyl group on an S-atom and an optionally-substituted hydrocarbyl group on an N-atom may be carried out at a temperature in the range of 0° C. to 150° C., or 20° C. to 80° C., or 25° C. to 50° C., optionally in the presence of a solvent and optionally in the presence of a catalyst. In one embodiment the reaction may be carried out in the presence of a catalyst. In one embodiment the reaction may be carried out in the presence of one or more solvents.

The reaction to prepare the ashless thiocarbamate compound having an optionally-substituted hydrocarbyl group on an S-atom and an optionally-substituted hydrocarbyl group on an N-atom may be carried out in an inert atmosphere or in air. The inert atmosphere may be a nitrogen or argon atmosphere (typically nitrogen).

The solvent may include a polar or non-polar medium. The solvent may for instance include acetone, toluene, xylene, tetrahydrofuran, diluent oil, Acetonitrile, N,N-dimethyl formamide, N,N-dimethyl acetamide, methyl ether ketone, t-butylmethyl ether, dimethoxy ethane, dichloromethane, or dichloroethane, or mixtures thereof.

The catalyst may be a tertiary amine such as tri-$C_{1-5}$-alkyl amine (typically triethylamine), tripropylamine, tributylamine, or diisopropylethylamine, or mixtures thereof.

The hydrocarbyl-substituted thiol (may also be referred to as a mercaptan) may have the hydrocarbyl group defined the same as $R_2$ above (that is to say the hydrocarbyl group may contain 2 to 60, or 4 to 30, or 6 to 20 carbon atoms). Examples of a hydrocarbyl-substituted thiol include ethyl thiol, butyl thiol, hexyl thiol, heptyl thiol, octyl thiol, 2-ethylhexyl thiol, nonyl thiol, decyl thiol, undecyl thiol, dodecyl thiol, tridecyl thiol, butadecyl thiol, pentadecyl thiol, hexadecyl thiol, heptadecyl thiol, octadecyl thiol, nonadecyl thiol, eicosyl thiol, or mixtures thereof.

The hydrocarbyl-substituted isocyanate may have the optionally-substituted hydrocarbyl group defined the same as $R_1$ above (that is to say the hydrocarbyl group may contain 2 to 60, or 4 to 30, or 6 to 20 carbon atoms). Examples of a hydrocarbyl-substituted isocyanate include cyclohexyl isocyanate, methyl isocyanate, ethyl isocyanate, propyl isocyanate, butyl isocyanate, pentylisocyanate, hexylisocyanate, heptylisocyanate, octylisocyanate, nonylisocyanate, decylisocyanate, undecyl isocyanate, dodecyl isocyanate, tridecyl isocyanate, tetradecyl isocyanate, pentadecyl isocyanate, hexadecyl isocyanate, heptadecyl isocyante, ocatadecyl isocyanate, nonadecyl isocyanate, allyl isocyanate, phenyl isocyanate, and its derivatives, such as benzyl isocyanate, tolyl isocyanate, ethylphenyl isocyanate, chlorophenyl isocyanate, or naphthyl isocyanate.

The hydrocarbyl-substituted diisocyanate may have the hydrocarbylene group defined the same as $R_3$ (that is to say the hydrocarbylene group may contain 1 to 16, or 2 to 10, or 4 to 8, such as 6 carbon atoms). Examples of a hydrocarbyl-substituted diisocyanate include isophorone diisocyanate, methylene-di-p-phenyl-diisocyanate, methylenediisocyanate, ethylenediisocyanate, diisocyanatobutane, diisocyanatohexane, cyclohexylene diisocyanate, toluene diisocyanate and methylene dicyclohexyl diisocyanate.

The hydrocarbyl-substituted diisocyanate may also have $R_4$ defined the same as $R_2$.

The hydrocarbyl-substituted diisocyanate compound may also be partially reacted with a hydrocarbyl-substituted thiol. Partial reaction may occur when there is a mole excess of the hydrocarbyl-substituted diisocyanate. In this situation, the product of reacting the hydrocarbyl-substituted diisocyanate with the hydrocarbyl-substituted thiol may be represented by formula (4), when Y is >O.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by. Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil. In one embodiment the oil of lubricating viscosity may be an API Group I oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finfished lubricant), the ratio of the of these additives to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives may include at least one of metal deactivators, viscosity modifiers, detergents, friction modifiers, antiwear agents (other than the ashless thiocarbamate compound having an optionally-substituted hydrocarbyl group on an S-atom and an optionally-substituted hydrocarbyl group on an N-atom of the present invention), corrosion inhibitors (other than the carbamate of the present invention), dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of a dispersant, an antiwear agent, a dispersant viscosity modifier, a friction modifier, a corrosion inhibitor (other than the carbamate of the present invention), a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

The dispersant of the present invention may be a succinimide dispersant, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may also be derived from a material having an aromatic amine. The aromatic amine that may be useful is disclosed in International publications WO2010/062842 and WO2009/064685 (a similar disclosure is provided in US 2010/298185). The aromatic amine of WO2009/064685 is typically reacted with isatoic anhydride.

The aromatic amine may typically not be a heterocycle. The aromatic amine may include aniline, nitroaniline, aminocarbazole, 4-aminodiphenylamine (ADPA), and coupling products of ADPA. In one embodiment the amine may be 4-aminodiphenylamine (ADPA), or coupling products of ADPA. The aromatic amine may include bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-di-amine, N-{4-[4-(4-amino-phenylamino)-benzyl]-phenyl}-2-[4-(4-amino-phenyl-amino)-cyclohexa-1,5-dienylmethyl]-benzene-1,4-diamine, N-[4-(7-amino-acridin-2-ylmethyl)-phenyl]-benzene-1,4-diamine, or mixtures thereof.

The dispersant may be a N-substituted long chain alkenyl succinimide. Examples of N-substituted long chain alkenyl succinimide include polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.1 wt % to 10 wt %, or 2.5 wt % to 6 wt %, or 3 wt % to 5 wt % of the lubricating composition.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the dispersant viscosity modifier may include those described in U.S. Pat. No. 7,790,661 column 2, line 48 to column 10, line 38. The dispersant viscosity modifier of U.S. Pat. No. 7,790,661 includes (a) a polymer comprising carboxylic acid functionality or a reactive equivalent thereof, said polymer having a number average molecular weight of greater than 5,000; and (b) an amine component comprising at least one aromatic amine containing at least one amino group capable of condensing with said carboxylic acid functionality to provide a pendant group and at least one additional group comprising at least one nitrogen, oxygen, or sulfur atom, wherein said aromatic amine is selected from the group consisting of (i) a nitro-substituted aniline, (ii) amines comprising two aromatic moieties linked by a —C(O)NR— group, a —C(O)O— group, an —O— group, an —N—N— group, or an —$SO_2$— group, wherein R is hydrogen or hydrocarbyl, one of said aromatic moieties bearing said condensable amino group, (iii) an aminoquinoline, (iv) an aminobenzimidazole, (v) an N,N-dialkylphenylenediamine, and (vi) a ring-substituted benzylamine.

In one embodiment the invention provides a lubricating composition which further includes a phosphorus-containing antiwear agent. Typically the phosphorus-containing antiwear agent may be a zinc dialkyldithiophosphate, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased detergent. The overbased detergent may be selected from the group consisting of non-sulphur containing phenates, sulphur containing phenates, sulphonates, salixarates, salicylates, and mixtures thereof.

The overbased detergent may also include "hybrid" detergents formed with mixed surfactant systems including phenate and/or sulphonate components, e.g., phenate/salicylates, sulphonate/phenates, sulphonate/salicylates, sulphonates/phenates/salicylates, as described, for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased detergent may be sodium, calcium or magnesium salt of the phenates, sulphur containing phenates, sulphonates, salixarates and salicylates. Overbased phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. In one embodiment the sulphonate detergent may be a metal salt of one or more oil-soluble alkyl toluene sulphonate compounds as disclosed in paragraphs [0046] to [0053] of US Patent Application 2008/0119378. The overbased detergent may be present at 0 wt % to 15 wt %, or 1 wt % to 10 wt %, or 3 wt % to 8 wt %. For example in a heavy duty diesel engine the detergent may be present at or 3 wt % to 5 wt % of the lubricating composition. For a passenger car engine the detergent may be present at 0.2 wt % to 1 wt % of the lubricating composition.

In one embodiment the lubricating composition includes an antioxidant, or mixtures thereof. The antioxidant may be present at 0 wt % to 15 wt 5, or 0.1 wt % to 10 wt %, or 0.5 wt % to 5 wt % of the lubricating composition.

Antioxidants include sulphurised olefins, alkylated diphenylamines (typically dinonyl diphenylamine, octyl diphenylamine, dioctyl diphenylamine), phenyl-α-naphthylamine (PANA), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butyl-phenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition. In one embodiment the lubricating composition may be free of long chain fatty esters (typically glycerol monooleate).

As used herein the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

In one embodiment the friction modifier may be selected from the group consisting of long chain fatty acid derivatives of amines, fatty esters, or fatty epoxides; fatty alkyl citrates, fatty alkyl tartrates; fatty alkyl tartrimides; and fatty alkyl tartramides.

In one embodiment the friction modifier may be a long chain fatty acid ester. In another embodiment the long chain fatty acid ester may be a mono-ester and in another embodiment the long chain fatty acid ester may be a triglyceride.

Other performance additives such as corrosion inhibitors include those described in paragraphs 5 to 8 of WO2006/047486, octyl octanamide, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles.

Foam inhibitors include polysiloxane or copolymers of ethyl acrylate and 2-ethylhexyl acrylate and optionally vinyl acetate.

Demulsifiers include trialkyl phosphates, polyethylene glycols, polyethylene oxides, polypropylene oxides and (ethylene oxide-propylene oxide) polymers.

Pour point depressants include esters of maleic anhydride-styrene, polymethacrylates, polyacrylates or polyacrylamides.

Demulsifiers include trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Thiocarbamate of Invention | 0.1 to 2 | 0.25 to 1.5 | 0.5 to 1 |
| Dispersant | 0.05 to 12 | 0.75 to 8 | 0.5 to 6 |
| Dispersant Viscosity Modifier | 0 to 5 | 0 to 4 | 0.05 to 2 |
| Overbased Detergent | 0 to 15 | 0.1 to 10 | 0.2 to 8 |
| Antioxidant | 0 to 15 | 0.1 to 10 | 0.5 to 5 |
| Antiwear Agent | 0 to 15 | 0.1 to 10 | 0.3 to 5 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

INDUSTRIAL APPLICATION

The lubricating composition may be utilised in an internal combustion engine. The engine components may have a surface of steel or aluminium (typically a surface of steel).

An aluminium surface may be derived from an aluminium alloy that may be a eutectic or hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine. In one embodiment the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The lubricating composition may be characterised as having at least one of (i) a sulphur content of 0.2 wt % to 0.4 wt % or less, (ii) a phosphorus content of 0.08 wt % to 0.15 wt %, and (iii) a sulphated ash content of 0.5 wt % to 1.5 wt % or less. The lubricating composition may be characterised as having (i) a sulphur content of 0.5 wt % or less, (ii) a phosphorus content of 0.1 wt % or less, and (iii) a sulphated ash content of 0.5 wt % to 1.5 wt % or less.

In one embodiment the lubricating composition may be characterised as having a sulphated ash content of 0.5 wt % to 1.2 wt %.

The following examples provide illustrations of the invention. These examples are non-exhaustive and are not intended to limit the scope of the invention.

EXAMPLES

Preparative Example 1 (EX1)

At room temperature a 500 mL 2-neck round bottom flask equipped with a nitrogen inlet and thermocouple is charged with 100 g of toluene, 111 g of isophorone diisocyanate and a catalytic amount of triethylamine (1 g). 202 g of n-dodecyl thiol is added slowly to keep the solution temperature below 40° C. The contents of the flask are stirred for 2 hours whilst partially sub-merged in a water bath. The temperature is maintained to ensure it does not rise above 40° C. After vacuum stripping, 245 g of a white product is obtained.

Preparative Example 2 (EX2)

At room temperature a 500 mL 2-neck round bottom flask equipped with a nitrogen inlet and thermocouple is charged with 50 g of tetrahydrofuran, 25 g of cyclohexyl isocyanate and a catalytic amount of triethylamine (1 g). 40.4 g of n-dodecyl thiol is added slowly over a period of 20 minutes. The contents of the flask are stirred for 48 hours After vacuum stripping, 62.6 g of a white product is obtained.

Preparative Example 3 (EX3)

At room temperature a 250 mL 2-neck round bottom flask equipped with a nitrogen inlet and thermocouple is charged with 100 g of toluene, 25 g of acetone, 41.6 g of isophorone diisocyanate, 8.4 g of 3-amino-1,2,4-triazole and a catalytic amount of triethylamine (200 mg). 60.6 g of n-dodecyl thiol is added slowly. The contents of the flask are heated to 40° C. and held for 2 hours. The contents of the flask are stirred throughout the 2 hours and for a further 16 hours. After vacuum stripping, 128.6 g of a light coloured oil product is obtained.

Preparative Example 4 (EX4)

At room temperature a 1 L 4-neck round bottom flask equipped with a nitrogen inlet and thermocouple is charged with 100 g of toluene, 150 g of methylene-di-p-phenyl-diisocyanate, 242 g of dodecylmercaptan and a catalytic amount of triethylamine (10 drops). The contents of the flask are stirred at room temperature for 3 hours. The flask is then heated to 50° C. and held for 4 hours. After vacuum stripping, 385 g of a white product is obtained.

Preparative Example 5 (EX5)

To a 4-necked 500 mL round bottom flask equipped with a mechanical stirrer, thermowell, nitrogen inlet, and friedrichs condenser is added isophorone diisocyanate (31.1 g, 140 mmol) and 50 ml of toluene. The reaction is capped with nitrogen, and stirred moderately. To the solution is added 5 drops of triethyl amine, which is followed by the dropwise addition of n-dodecyl mercaptan (28.3 g, 140 mmol) in 15 minutes. The internal temperate increases from 21.3° C. to 42.4° C. after the addition. The reaction mixture is stirred for 3 hours at room temperature. Then the temperature is increased to 50° C., and is stirred for another 2.5 hours. The contents of the flask are then cooled to 18° C., and 1-phenyl-1H-tetrazole-5-thiol (25 g, 140 mmol) is then added all at once followed by another 10 drops of triethyl amine. The 1-phenyl-1H-tetrazole-5-thiol white solid powder does not dissolve in the solution. The contents of the flask are heated to 40° C. over a period of 2 hours. The solid is observed to dissolve slowly during the process of heating. The internal temperature is increased to 50° C. and held for 4 hours until the IR spectra remains unchanged. To the solution is added 1 g of n-dodecyl mercaptan (DDSH), and the heating is continued for another 3 hours. The solvent is evaporated under vacuum (50° C. with a vacuum of 400 Pa (or 3 mmHg)). A total of 84 g of product is produced (98% yield).

Preparative Example 6 (EX6)

To a 4-necked 500 mL round bottom flask equipped with a mechanical stirrer, thermowell, nitrogen inlet, and friedrichs condenser is added isophorone diisocyanate (31.1 g, 140 mmol) and 50 ml of toluene. The reaction is capped with nitrogen, and stirred moderately. To the solution is added 10 drops of triethyl amine, which is followed by batch wise addition of 1-phenyl-1H-tetrazole-5-thiol (25 g, 140 mmol) in 15 minutes. The solid material does not dissolve in toluene at the beginning. The solid material slowly disappears into the solution in about one hour, and the internal temperature increases very modestly for only 6° C. during the process. The internal temperate increases 50° C., and to the solution is added T9 catalyst 1 drop, and held for 2 hours at this temperature. The reaction has a slight exotherm after T9 (stannous octoate) addition. The reaction mixture is cooled to room temperature. Then to the solution is added dropwise n-dodecyl mercaptan (28.3 g, 140 mmol). There is no exotherm observed during the whole process. To the solution is added T9 catalyst 1 drop. The solution is heated to 60° C. The reaction is monitored by IR analysis until the IR spectra remains unchanged. After 3 hours, to the solution is added another 6 drops of T9. The solution temperature is increased to 70° C., and held for 2 hours. The solvent is evaporated under vacuum (60° C./400 Pa (3 mmHg)). A total of 84 g of product is produced (98% yield).

Preparative Example 7 (EX7)

To a 4-necked 500 mL round bottom flask equipped with a mechanical stirrer, thermowell, nitrogen inlet, and friedrichs condenser is added phenyl isocyanate (47.6 g, 0.4 mol) and 60 ml of toluene. The reaction is capped with nitrogen and stirred moderately. To the solution is added 6 drops of triethyl amine, which is followed by the dropwise addition of n-dodecyl mercaptan (81 g, 0.4 mol) in 30 minutes. There is a strong exotherm of 35° C. observed during the whole process. The solution is stirred for another 1 hour at this temperature. The solution is then heated to 55° C., and held for 5 hours. The flask is cooled to room temperature. The solvent is evaporated under vacuum (60° C./1300 Pa (10 mmHg)). A total of 128 g of white solid product is produced (100% yield).

Preparative Example 8 (EX8)

To a 4-necked 5000 mL round bottom flask equipped with a mechanical stirrer, thermowell, nitrogen inlet, and friedrich's condenser is added phenyl isocyanate (893 g, 7.5 mol) and 800 ml of toluene. The reaction is capped with nitrogen, and stirred moderately. To the solution is added 1.2 g of triethyl amine. Then n-dodecyl mercaptan (1516 g, 7.5 mol) is added dropwise over a period of 2 hour 15 minutes. The n-dodecyl mercaptan is added at a rate to ensure the exotherm is controlled. The temperature is not higher than 60° C. after n-dodecyl mercaptan addition. There is a strong exotherm of about 40° C. observed during the whole process. The solution is cooled down to about 58° C., and trace amount of solid is observed at this point. The solution is heated to 65° C. and held with stirring for 2 hours. The reaction is monitored by IR analysis until the IR spectra remains unchanged. The solvent is stripped under vacuum (65 to 85° C./930 Pa (7 mmHg)). A total of 2420 g of white solid product is produced. The white solid is broken into smaller pieces, and further dried under vacuum using house vacuum over night to afford final product as white solid (2405 g, 100% yield).

Preparative Example 9 (EX9)

To a 4-necked 500 mL round bottom flask equipped with a mechanical stirrer, thermowell, nitrogen inlet, and friedrichs condenser is added hexamethylene diisocyanate (25.2 g, 0.15 mol) and 100 ml of toluene. The reaction is capped with nitrogen and stirred moderately. To the solution is added 5 drops of triethyl amine, which is followed by the dropwise addition of n-dodecyl mercaptan (60.6 g, 0.3 mol) over a period of 1 hour. The reaction has an exotherm of 30° C. The flask is then heated to 75° C., and held for 5 hours. The reaction is monitored by IR analysis until the IR spectra remains unchanged. After about 5 hours, the flask is cooled followed by solvent extraction at 40° C. A total of 84 g of white solid product is produced (98% yield).

Preparative Example 10 (EX10)

To a 4-necked 500 mL round bottom flask equipped with a mechanical stirrer, thermowell, nitrogen inlet, and friedrichs condenser is added hexamethylene diisocyanate (25.2 g, 0.15 mol) and 100 ml of toluene. The reaction is capped with nitrogen, and stirred moderately. To the solution is added 5 drops of triethyl amine, which is followed by the dropwise addition of n-dodecyl mercaptan (30.3 g, 0.15 mol) over a period of 30 minutes. The reaction exotherm is 30° C. 2-hydroxyethyl acetamide (15.5 g, 0.15 mol) is then added to the flask. The mixture is heated to 75° C., and held for 5 hours. The reaction is monitored by IR analysis until the IR spectra remains unchanged. The flask is then cooled and solvent is removed in a vacuum oven at 40° C. A total of 69 g of white solid product is produced (97% yield).

Preparative Example 11 (EX11)

To a 4-necked 500 mL round bottom flask equipped with a mechanical stirrer, thermowell, nitrogen inlet, and friedrichs condenser is added isophorone diisocyanate (26.7 g, 120 mmol) and 40 ml of toluene. The reaction is capped with nitrogen and stirred moderately. To the solution is added 5 drops of triethyl amine, which is followed by the dropwise addition of n-dodecyl mercaptan (24.3 g, 120 mmol) over a period of 10 minutes. The exotherm raises the temperature of the flask from 20° C. to 40° C. The contents of the flask are stirred for 30 minutes. The temperature is then increased to 60° C., and held for 2.5 hours. The contents of the flask are stirred throughout. The flask is then cooled to 20° C., and 2-hydroxypyridine (11.4 g, 120 mmol) is added. There is an exotherm of 4.5° C. observed. The content is slowly heated to 70° C. and held for 1 hour. The flask is maintained at 70° C. for 4 hours. The solvent is evaporated under vacuum (40° C./1070 Pa (8 mmHg)). A total of about 63 g of product is produced (100% yield).

Preparative Example 12 (EX12)

To a 4-necked 500 mL round bottom flask equipped with a mechanical stirrer, thermowell, nitrogen inlet, and friedrichs condenser is added isophorone diisocyanate (26.7 g, 120 mmol) and 40 ml of toluene. The reaction is capped with nitrogen and stirred moderately. To the solution is added 5 drops of triethyl amine, which is followed by the addition of 2-hydroxypyridine (11.4 g, 120 mmol). There is an exotherm that raises to the temperature from 18° C. to 32° C. The contents of the flask are stirred for 30 minutes without additional heating. The flask is then heated to 70° C., and the contents of the flask are stirred for 2 hours. The flask is then cooled to 21° C. n-dodecyl mercaptan (24.3 g, 120 mmol) is added over a period of 10 minutes. There is no exotherm observed. 2 drops of triethyl amine is added. The flask is then heated to 70° C. and held for 1 hour. 5 drops of triethyl amine is added. The content is slowly heated to 95° C. and stirred for 2.5 hours before addition of n-dodecyl mercaptan (DDSH) (0.6 g). The contents of the flask are stirred for 1 hour. The flask is cooled and solvent is evaporated under vacuum (30-70° C./530 Pa (4 mmHg)). A total of about 63 g of product is produced (100% yield).

Preparative Example 13 (EX13)

To a 4-necked 500 mL round bottom flask equipped with a mechanical stirrer, thermowell, nitrogen inlet, and friedrichs condenser is added toluene diisocyanate (26.1 g, 0.15 mol) and 60 ml of toluene. The reaction is capped with nitrogen and stirred moderately. To the solution is added 5 drops of triethyl amine, which is followed by the dropwise addition of n-dodecyl mercaptan (60.6 g, 0.30 mol) over a period of 30 minutes. There is an exotherm of 32° C. The flask is heated to 90° C. and held for a total of around 2 hours. The reaction is monitored by IR analysis until the IR spectra remains unchanged. The flask is cooled and solvent is evaporated in vacuum oven at 40° C. A total of 84.5 g of white solid product is produced (97% yield).

Preparative Example 14 (EX14)

To a 4-necked 500 mL round bottom flask equipped with a mechanical stirrer, thermowell, nitrogen inlet, and friedrichs condenser is added isophorone diisocyanate (31.0 g, 140 mmol) and 40 ml of toluene. The reaction is capped with nitrogen and stirred moderately. To the solution is added 10 drops of triethyl amine, which is followed by the addition of n-dodecyl mercaptan (28.3 g, 140 mmol) over a period of 18 minutes. An exotherm of about 20° C. is observed. The contents of the flask are stirred for 20 minutes without additional heating. The temperature is increased to 90° C. and held. The contents of the flask are stirred for 3 hours. The flask is cooled to 80° C. Triethylamine (10 drops) is added, followed by the addition of 4-hydroxypyridine (13.3 g, 140 mmol). The reaction mixture is then heated to 90° C. and held for 3 hours with stirring. The reaction is followed by IR analysis until the IR spectra remains unchanged. The product is a solution that is then filtered to obtain a clear solution. Solvent is evaporated under vacuum (30° C./530 Pa (4 mmHg)). A total of about 70.0 g of viscous product is produced (96% yield).

Preparative Example 15 (EX15)

To a 4-necked 500 mL round bottom flask equipped with a mechanical stirrer, thermowell, nitrogen inlet, and friedrichs condenser is added isophorone diisocyanate (26.7 g, 120 mmol) and 40 ml of toluene. The reaction is capped with nitrogen and stirred moderately. To the solution is added 10 drops of triethyl amine, which is followed by the addition of 4-hydroxypyridine (11.4 g, 120 mmol). The 4-hydroxypyridine stays at solid state without dissolving. The contents of the flask are stirred for 30 minutes without heating. Then the temperature is increased to 90° C. The solid starts to dissolve at about 85° C. The flask is held at 90° C. for 2 hours with continuous stirring. Triethylamine (5 drops) is added followed by the dropwise addition of n-dodecyl mercaptan (24.3 g, 120 mmol) over a period of 15 minutes. An exotherm of about 5° C. is observed. The heating and stirring are continued for a total of 4 hours. The reaction is followed by IR analysis until the IR spectra remains unchanged. The solvent is evaporated under vacuum (at 30° C. with a pressure of 530 Pa (4 mmHg)). A total of about 58.2 g of product is produced (93% yield).

Preparative Example 16 (EX16)

To a 4-necked 500 mL round bottom flask equipped with a mechanical stirrer, thermowell, nitrogen inlet, and friedrichs condenser is added hexamethylene diisocyanate (20.2 g, 0.12 mol) and 40 ml of toluene. The reaction is capped with nitrogen, and stirred moderately. To the solution is added 10 drops of triethyl amine, followed by the dropwise addition of 2-ethylhexyl alcohol (15.6 g, 0.12 mol) over a period of 10 minutes. The reaction temperature is increased to 92° C. The flask is held at 92° C. and the contents stirred for 1.5 hours. n-dodecyl mercaptan is added (24.2 g, 0.12 mol) over a period of 20 minutes. The flask is then heated to 96° C. and held for 4 hours. The reaction is monitored by IR analysis until the IR spectra remains unchanged. The flask is cooled and solvent is removed under vacuum. 58 g of white solid product (97% yield) is obtained.

Preparative Example 17 (EX17)

To a 4-necked 500 mL round bottom flask equipped with a mechanical stirrer, thermowell, nitrogen inlet, and friedrichs condenser is added hexamethylene diisocyanate (25.2 g, 0.15 mol) and 40 ml of toluene. The reaction is capped with nitrogen and stirred moderately. To the solution is added 10 drops of triethyl amine, which is followed by the dropwise addition of 2-ethylhexyl alcohol (19.5 g, 0.15 mol). The flask is then heated to 92° C. The reaction is kept at this temperature for a total of 2.5 hours and the flask contents are stirred. Octanthiol (22.0 g, 0.15 mol) is added over a period of 20 minutes. The temperature is maintained at 92° C. for 3 hours with continuous stirring of the flask contents. The reaction is monitored by IR analysis until the IR spectra remains unchanged. The flask is cooled and solvent is removed by vacuum. The product is dried under vacuum to afford a total of 66 g of white solid product (99% yield)

Preparative Example 18 (EX18)

To a 4-necked 500 mL round bottom flask equipped with a mechanical stirrer, thermowell, nitrogen inlet, and friedrichs condenser is added isophorone diisocyanate (22.2 g, 100 mmol) and 30 ml of toluene. The reaction is capped with nitrogen and stirred moderately. To the solution is added 10 drops of triethyl amine, followed by the addition of tolyl triazole (6.6 g, 50 mmol) and 3-amino-1,2,4-triazole (4.2 g, 50 mmol). The flask is heated to 70° C., and held for 2 hours. The resultant solution has a very light hint of haze at the end of this process. To the solution is added dropwise n-dodecyl mercaptan (20.2 g, 100 mmol) over a period of 20 minutes. The flask is then heated to 90° C. and held for 2.5 hours. The solvent is evaporated under vacuum (70° C./400 Pa (3 mmHg)). A total of 54 g of product is produced (100% yield).

Preparative Example 19 (EX19)

To a 4-necked 250 mL round bottom flask equipped with a mechanical stirrer, thermowell, nitrogen inlet, and friedrichs condenser is added isophorone diisocyanate (22.2 g, 100 mmol) and 30 ml of toluene. The reaction is capped with nitrogen, and stirred moderately. Hydroxymethyl pyridine (10.9 g, 100 mmol) is added to the flask. The hydroxyl pyridine does not dissolve. The reaction mixture is stirred for 30 minutes without heating. The flask is heated to 55° C. There is an exotherm that raises the temperature to 65° C. The flask is then heated to 90° C. and held for 3 hours whilst continuously stirring. The flask is then cooled to 80° C. Triethylamine (10 drops) is then added, followed by the addition of n-dodecyl mercaptan (20.2 g, 100 mmol). An exotherm of about 10° C. is observed. The flask is then heated to 90° C. and held for 2.5 hours. After cooling, solvent is removed from the product under vacuum (70° C./530 Pa (4 mmHg)). A total of about 52 g of product is produced (98% yield).

Preparative Example 20 (EX20)

To a 4-necked 500 mL round bottom flask equipped with a mechanical stirrer, thermowell, nitrogen inlet, and friedrichs condenser is added isophorone diisocyanate (22.2 g, 100 mmol) and 40 ml of toluene. The reaction is capped with nitrogen, and stirred moderately. The flask is charged with 5 drops of triethyl amine and hydroxylethyl pyrrolidinone (12.9 g, 100 mmol) is added. The contents of the flask are mixture is stirred at 20° C. for 30 minutes. The flask is then heated to 90° C., and held for 2 hours at this temperature. n-dodecyl mercaptan (20.2 g, 100 mmol) is added. The flask is maintained at 90° C. for 2.5 hours. After cooling solvent is evaporated under vacuum (70° C./530 Pa (4 mmHg)). A total of 55.8 g of product is produced (100% yield).

Preparative Example 21 (EX21)

To a 4-necked 500 mL round bottom flask equipped with a mechanical stirrer, thermowell, nitrogen inlet, and friedrichs condenser is added isophorone diisocyanate (22.2 g, 100 mmol) and 40 ml of toluene. The reaction is capped with nitrogen and stirred moderately. The flask is charged with 5 drops of triethylamine, and then n-dodecyl mercaptan (20.2 g, 100 mmol) is added. An exotherm raises the temperature to 47° C. The contents of the flask are stirred for 10 minutes. The flask is then heated to 90° C. and held for 1.5 hours with continuous stirring. The heat source is removed and, as the flask is cooling, aminoethyl ethylene urea (12.9 g, 100 mmol) is added. An exotherm raises the temperature to 98° C. After cooling to 90° C., the flask is maintained at 90° C. for 1.0 hours. The flask is then heated to 95° C. and held for one hour and then increased to 95° C. for 1.0 hours. The solvent is removed with a vacuum oven, giving viscous light yellow product (50.0 g, 90% yield).

Comparative Lubricant 1 (CL1): a fully formulated SAE 15W-40 heavy duty diesel engine lubricant is prepared containing typical amounts of additives such as succinimide dispersant, overbased detergents, and zinc dialkyldithiophosphate.

Lubricant Examples 1 (LE1) to 21 (LE21) are SAE 15W-40 lubricants similar to CL1, except they contain 0.1 wt % of the product of EX1 to EX21 respectively.

Test 1: Lead Corrosion Test

The lubricants described above (LE1 to LE21 and CL1) are evaluated in lead corrosion test as defined in ASTM Method D6594-06. The amount of lead (Pb) in the oils at the end of test is measured and compared to the amount at the beginning of the test. Lower lead content in the oil indicates decreased lead corrosion. Overall the results obtained for each lubricant are as follows:

| Example | Lead (ppm) |
|---|---|
| CL1 | 87 |
| LE1 | 19 |
| LE2 | 17 |
| LE3 | 30 |
| LE4 | N.M. |
| LE5 | 85 |
| LE6 | 86 |
| LE7 | 35 |
| LE8 | 36 |
| LE9 | 15 |
| LE10 | 34 |
| LE11 | 55 |
| LE12 | 51 |
| LE13 | 16 |
| LE14 | 119 |
| LE15 | 103 |
| LE16 | 28 |
| LE17 | 35 |

-continued

| Example | Lead (ppm) |
|---|---|
| LE18 | 35 |
| LE19 | 24 |
| LE20 | 34 |
| LE21 | 70 |

Footnote:
N.M.—indicates a data point not measured

The data presented indicates that many of the lubricating composition of the invention (for example, an internal combustion engine lubricant) containing an ashless thiocarbamate compound as defined by the invention provide resistance to lead corrosion.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to of published application US 2010-0197536.

As used herein the term "hydrocarbylene" is used in a similar way as hydrocarbyl, except where the hydrocarbyl group has a carbon atom directly attached to the remainder of the molecule e.g., an alkyl group. In contrast, a hydrocarbylene group is attached to two atoms within the molecule e.g., an alkylene group (e.g., —$CH_2CH_2CH_2$—).

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and 0.01 wt % to 5 wt % of an ashless sulfur containing compound comprising a thiocarbamate compound having an optionally-substituted hydrocarbyl group on an S-atom and an optionally-substituted hydrocarbyl group on an N-atom, wherein the ashless thiocarbamate compound having an optionally-substituted hydrocarbyl group on an S-atom and an optionally-substituted hydrocarbyl group on an N-atom is represented by the formula (4):

formula (4)

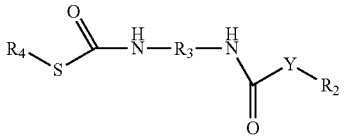

wherein

Y is S;

$R_2$ is a hydrocarbyl group consisting of 6 to 20 carbon atoms;

$R_3$ is a hydrocarbylene group; and $R_4$ is a hydrocarbyl group consisting of 6 to 20 carbon atoms.

2. The lubricating composition of claim 1, wherein the ashless thiocarbamate compound having an optionally-substituted hydrocarbyl group on an S-atom and an optionally-substituted hydrocarbyl group on an N-atom comprises one or more linear hydrocarbyl groups.

3. The lubricating composition of claim 1, wherein the ashless thiocarbamate compound having an optionally-substituted hydrocarbyl group on an S-atom and an optionally-substituted hydrocarbyl group on an N-atom comprises one linear hydrocarbyl group and one branched hydrocarbyl group.

4. The lubricating composition of claim 1, wherein the ashless thiocarbamate compound having an optionally-substituted hydrocarbyl group on an S-atom and an optionally-substituted hydrocarbyl group on an N-atom comprises one or more cyclic hydrocarbyl groups.

5. The lubricating composition of claim 1, wherein the ashless thiocarbamate compound having an optionally-substituted hydrocarbyl group on an S-atom and an optionally-substituted hydrocarbyl group on an N-atom comprises one cyclic hydrocarbyl group and one linear hydrocarbyl group.

6. The lubricating composition of claim 1, wherein the ashless thiocarbamate compound having an optionally-substituted hydrocarbyl group on an S-atom and an optionally-substituted hydrocarbyl group on an N-atom is halogen free.

7. The lubricating composition of claim 1, wherein the ashless thiocarbamate compound having an optionally-substituted hydrocarbyl group on an S-atom and an optionally-substituted hydrocarbyl group on an N-atom is present at 0.5 wt % to 1 wt %.

8. The lubricating composition of claim 1, wherein the ashless thiocarbamate compound having an optionally-substituted hydrocarbyl group on an S-atom and an optionally-substituted hydrocarbyl group on an N-atom is present at 0.25 wt % to 1 wt % of the lubricating composition.

9. The lubricating composition of claim 1 wherein the lubricating composition is characterised as having (i) a sulphur content of 0.5 wt % or less, (ii) a phosphorus content of 0.1 wt % or less, and (iii) a sulphated ash content of 0.5 wt % to 1.5 wt % or less.

10. The lubricating composition of claim 1, wherein the composition is free of long chain fatty esters.

11. The lubricating composition of claim 1 further comprising a phosphorus-containing antiwear agent wherein the phosphorus-containing antiwear agent comprises zinc dialkyldithiophosphate.

12. The lubricating composition of claim 1 further comprising an overbased detergent, wherein the overbased detergent is typically selected from the group consisting of phenates, sulphur containing phenates, sulphonates, salixarates, salicylates, and mixtures thereof, wherein the overbased detergent is present at 1 wt % to 10 wt %, or 3 wt % to 8 wt %.

13. The lubricating composition of claim 1 further comprising a succinimide dispersant, wherein the succinimide dispersant is present at 2.5 wt % to 6 wt %, or 3 wt % to 5 wt %.

14. The lubricating composition of claim 1, wherein the lubricating composition has a TBN in the range of 6 to 10 mg KOH/g.

15. A method of lubricating an internal combustion engine comprising supplying to the internal combustion engine a lubricating composition of claim 1.

16. The method of claim 15, wherein the internal combustion engine is lubricated with a lubricating composition of claim 1, and wherein the engine has a steel surface on a cylinder bore, a cylinder block, or a piston ring.

17. A method of lubricating a heavy duty diesel internal combustion engine comprising supplying to the heavy duty diesel internal combustion engine a lubricating composition of claim 1.

* * * * *